US005759083A

United States Patent [19]

Polumbaum et al.

[11] Patent Number: 5,759,083

[45] Date of Patent: Jun. 2, 1998

[54] TOY VEHICLE WITH INTEGRAL BALL PLAYING APPARATUS

[75] Inventors: Douglas Polumbaum, Roxbury, Conn.; Sean R. O'Meallie, Colorado Springs, Colo.

[73] Assignee: Soma International Ltd., Kowloon, Hong Kong

[21] Appl. No.: 786,743

[22] Filed: Jan. 24, 1997

[51] Int. Cl.[6] ..... A63H 17/00; A63H 29/00

[52] U.S. Cl. ..... 446/435; 446/429; 173/129 V

[58] Field of Search ..... 446/429, 430, 446/435, 333, 334, 335, 336, 437, 470, 471; 273/129 V

[56] References Cited

U.S. PATENT DOCUMENTS

| | | | |
|---|---|---|---|
| 1,289,621 | 12/1918 | Blackshear | 446/435 |
| 1,658,054 | 2/1928 | Levy | 446/336 X |
| 1,728,799 | 9/1929 | Levin et al. | 446/336 X |
| 4,085,540 | 4/1978 | Jernstrom et al. | 446/333 |
| 4,186,518 | 2/1980 | Luke | 446/333 |
| 4,380,135 | 4/1983 | Wildman et al. . | |
| 4,443,968 | 4/1984 | Law . | |
| 4,911,669 | 3/1990 | Parker | 446/435 X |
| 5,297,260 | 3/1994 | Tilbor et al. | 446/336 X |

FOREIGN PATENT DOCUMENTS

| | | | |
|---|---|---|---|
| 525353 | 8/1940 | United Kingdom . | |
| 1420193 | 1/1976 | United Kingdom | 446/333 |
| 2085739 A | 5/1982 | United Kingdom . | |

*Primary Examiner*—Robert A. Hafer
*Assistant Examiner*—D. Neal Muir
*Attorney, Agent, or Firm*—Buchanan Ingersoll, P.C.

[57] ABSTRACT

A toy vehicle has an object projecting apparatus mounted on a chassis and enclosed by a removable body or cover. The object projecting apparatus includes a spring loaded arm and a catch and release mechanism. The spring loaded arm can be shaped like a baseball bat or have a hand or shoe for hitting, throwing or kicking a ball. The catch and release mechanism preferably has several spaced apart movable tabs which selectively engage a catch tab o the arm. This allows the spring loaded arm to be releasably held at one of several positions so that when released the arm will strike or throw a ball at different forces, each force corresponding to the selected position.

20 Claims, 11 Drawing Sheets

FIG. 3
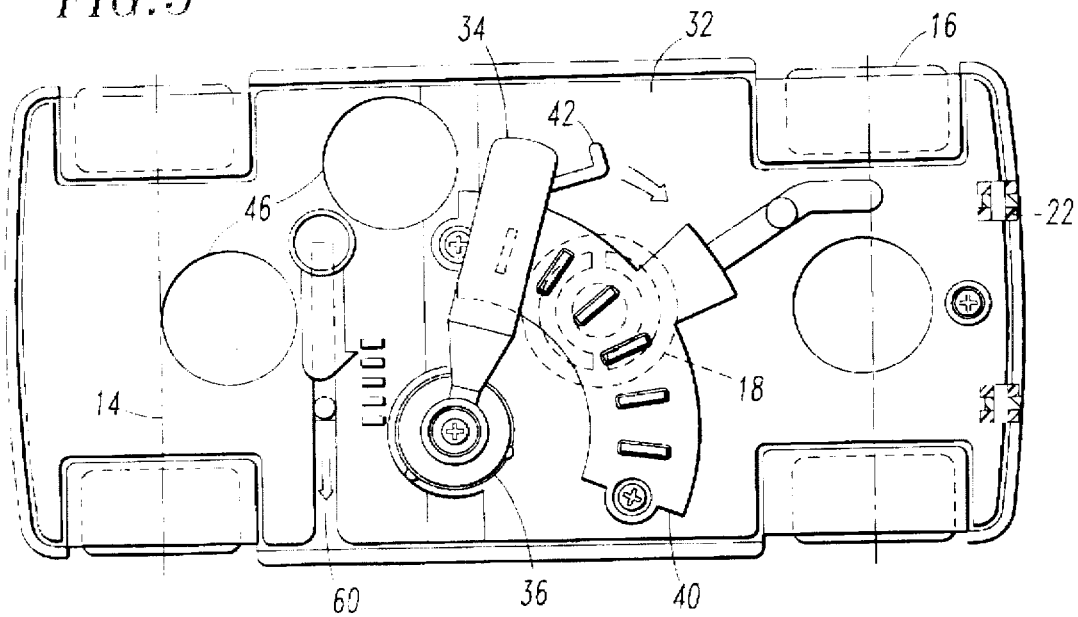
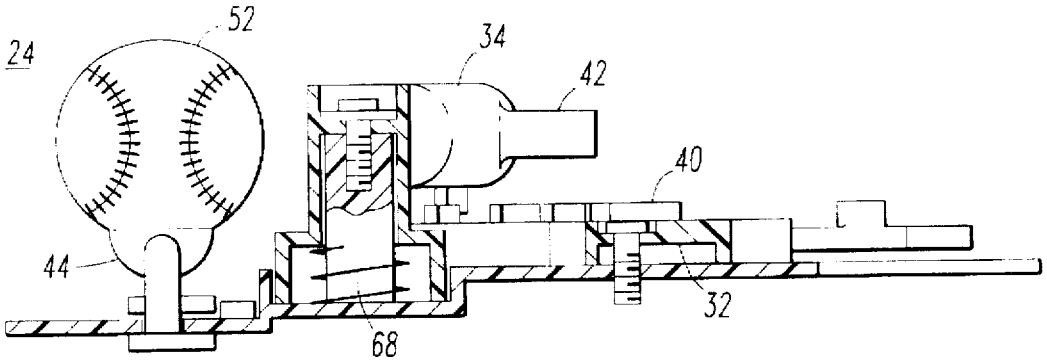
FIG. 4

FIG. 7
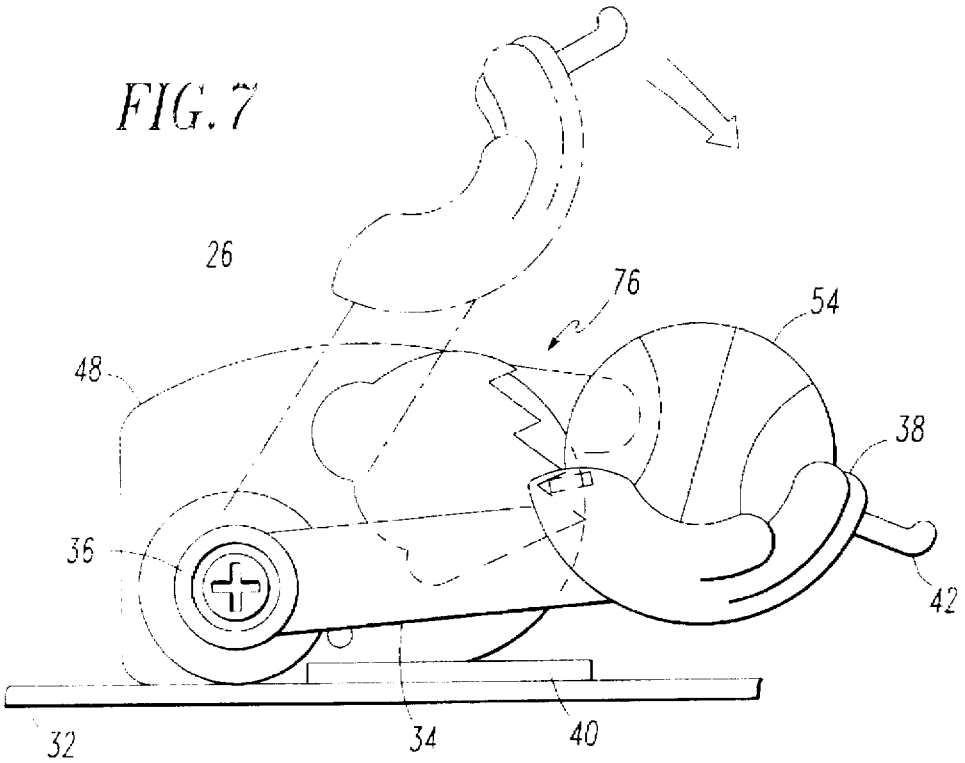
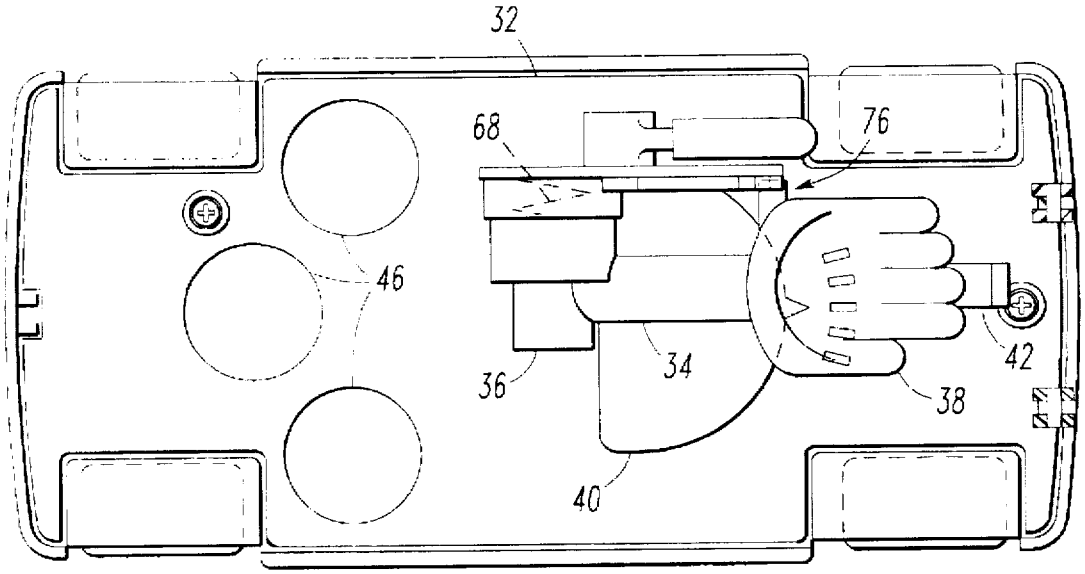
FIG. 8

FIG. 14
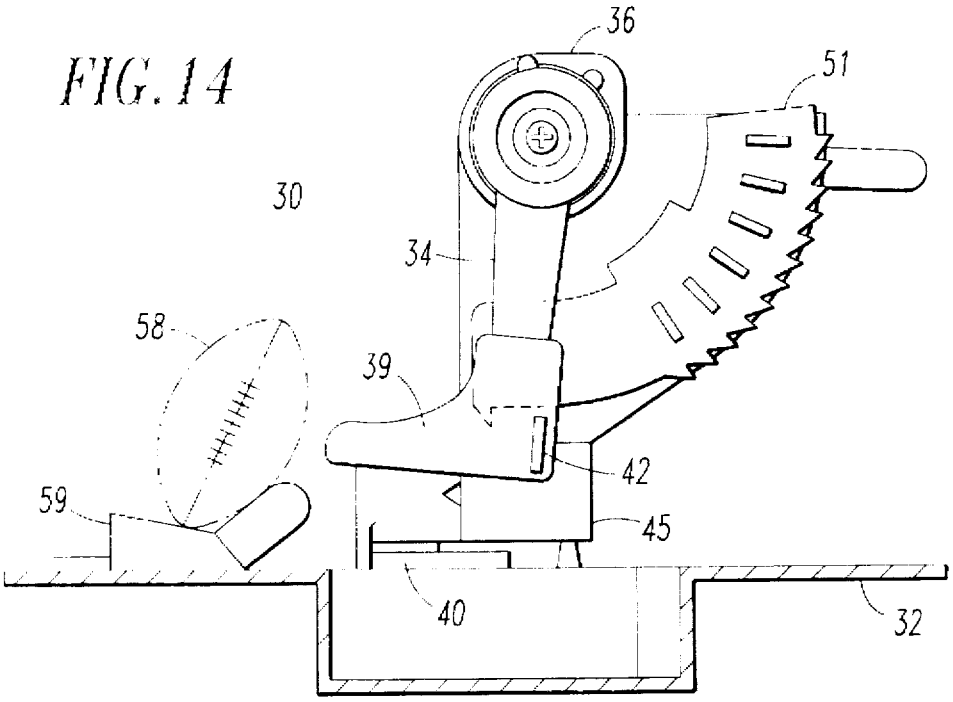
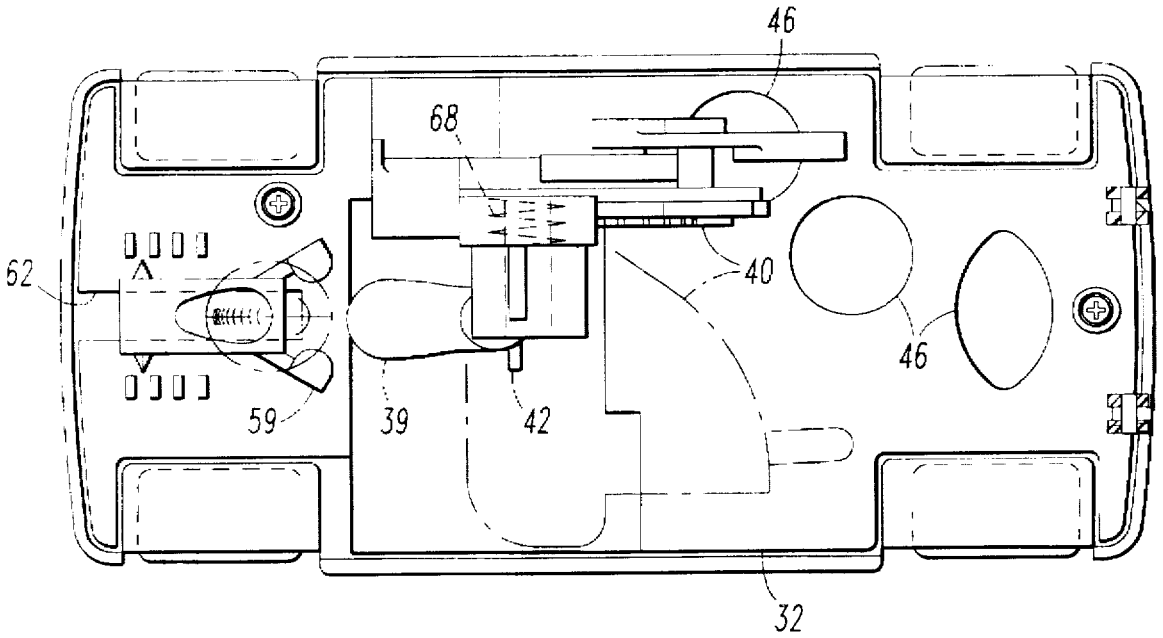
FIG. 15

TOY VEHICLE WITH INTEGRAL BALL PLAYING APPARATUS

BACKGROUND OF THE INVENTION

1. Field of the Invention

The invention relates generally to toy vehicles and more particularly to a combination toy vehicle and ball playing game.

2. Description of Related Art

There are many toys which allow the child to participate in several different types of play. Common examples of such toys are multiple game packs which include in one package the playing pieces to play more than one game. A more recent trend in the toy industry is to create toys which can be converted by the child from one type of toy to another type of toy. One line of toys sold under the TRANSFORMERS trademark includes robots or action figures which can be converted into dinosaurs or toy vehicles. One reason why these toys have been popular is because they permit multiple modes of play.

Toy vehicles having compartments which can be opened and closed are well-known. There have also been toy vehicles which had removable tops. The interior of these vehicles and compartments has either been configured to replicate a full size vehicle interior, or to hold playpieces sold with the vehicle. Although these vehicles have been popular, they do not provide the multiple play value of the TRANSFORMER toys.

Several toys have been created to replicate outdoor sports such as baseball and football and arena sports such as hockey. One type of these toys has a playing surface and a movable bat, stick or other striking piece which a player can operate to hit a ball or kick it into a goal. Most of these toys are at least a foot long. Attempts to miniaturize these toys has led to hand-held video games, but not to smaller mechanical toys.

There has never been a single toy which integrally combines outdoor sports like baseball, football and soccer with a toy vehicle to allow a child engage in two different modes of play. Yet, such a toy would provide the multiple modes of play which children desire. Thus, there is a need for a new toy which entertainingly combines toy vehicles with ball playing games.

SUMMARY OF THE INVENTION

A toy vehicle having an integral ball playing apparatus is provided. The toy vehicle includes a chassis having two axles, a pair of wheels on each axle, and a body which may be in the shape of a sports car. A platform is provided on the chassis and attached to the platform is an apparatus for hitting, kicking, throwing or otherwise projecting a ball or other object.

The apparatus includes a spring loaded arm with one end operatively attached to a spring and anchored to the platform or a base mounted thereon and an opposite end positioned to project the ball or other object. The opposite end includes a finger tab extending outwardly therefrom for conveniently drawing the arm back against the spring. The apparatus also includes a catch mechanism for holding the spring loaded arm at variable positions once it has been drawn back against the spring. A catch release is also provided to release the arm to project the object. The apparatus further includes an object holder and an aiming mechanism. Additionally, the spring loaded arm may be attached to the platform or base in a manner to allow it to fold down when not in use. The platform is provided with one or more indentions therein for storing objects to be projected. The body is hinged at the back end to the chassis and releasably latched at the front end so that it may be lifted up to expose the object projecting apparatus.

Other details, objects and advantages of the invention will become apparent from the following description of the preferred embodiments shown in the drawings.

BRIEF DESCRIPTION OF THE DRAWINGS

FIG. 3 is a top plan view of the first present preferred embodiment with the body removed to illustrate a first present preferred embodiment of our object projecting apparatus;

FIG. 4 is a side view of the first present preferred embodiment of the object projecting apparatus shown in FIGS. 2 and 3;

FIG. 7 is a side view of a second present preferred embodiment of our object projection apparatus;

FIG. 8 is a top plan view of the object projecting apparatus shown in FIG. 7 with the arm in the fully advanced position;

FIG. 14 is a side view of a fourth present preferred embodiment of our object projecting apparatus;

FIG. 15 is a top plan view of the object projecting apparatus shown in FIG. 14;

DETAILED DESCRIPTION OF THE PREFERRED EMBODIMENTS

Figure 1:
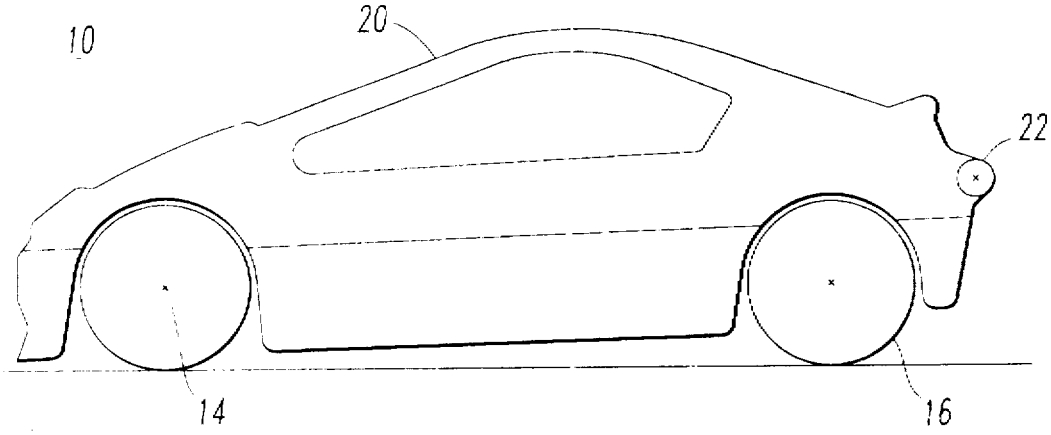
FIG. 1 is a side view of a first present preferred embodiment of our toy vehicle having an integral ball playing apparatus.
Figure 2:
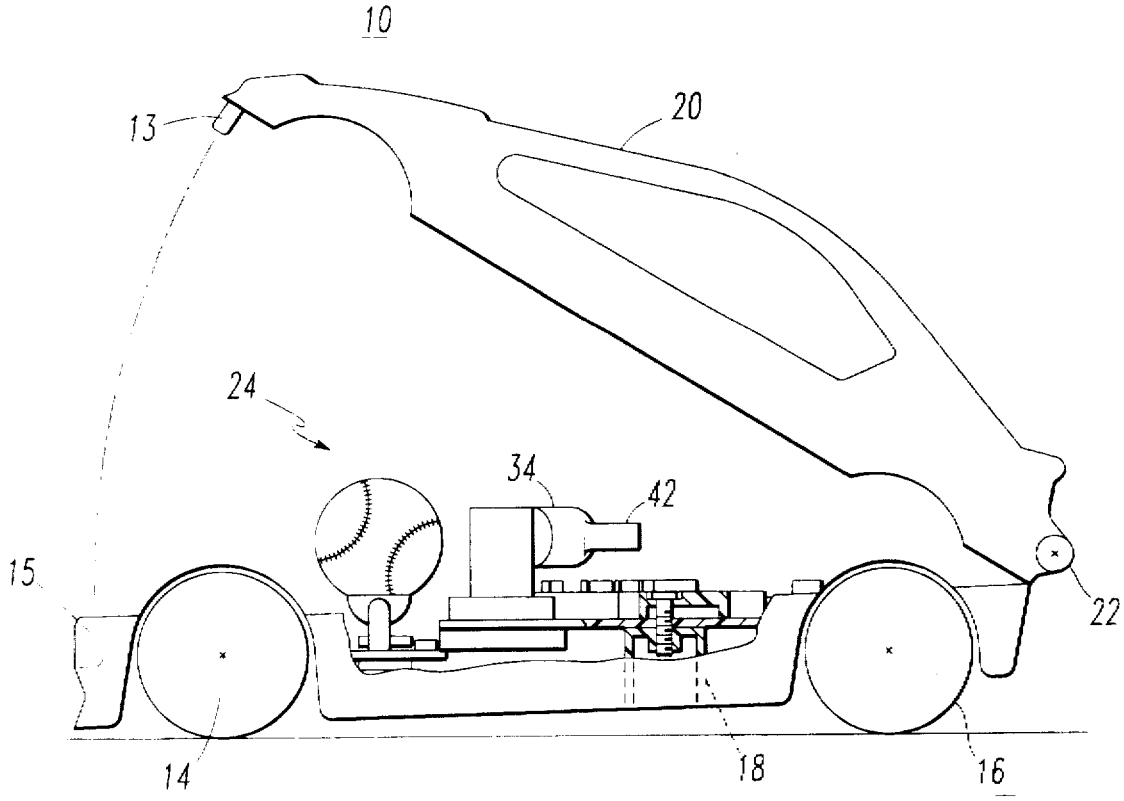
FIG. 2 is a side view partially in section of the first present preferred embodiment shown in FIG. 1 with the body of the vehicle raised.

The present preferred embodiments of our invention are shown in the drawings in which like parts are designated by like reference numerals throughout the several figures. A first present preferred embodiment shown in FIGS. 1 and 2 is a toy vehicle 10 having a chassis 12 and spaced apart axles 14 carried by the chassis for rotation relative thereto. Each end of the axles 14 has a wheel 16. Although we prefer to provide four wheels, a lesser or greater number of wheels may be used. The chassis also has an integrally molded central spring anchor 18. The rear part of the body 20 of the toy vehicle 10 is attached to the chassis 12 by a hinge 22. A downward projecting tab 13 is provided at the front of the body and is aligned to be received in a slot 15 at the front of the chassis. The tab 13 and slot 15 are sized and positioned such that a friction between the two serves to hold the body to the chassis 12 when the body 20 is lowered thereon. The body 20 may be raised up by releasing the tab 13 and rotating the body 20 about the hinge 22 in order to expose the object projecting apparatus 24 mounted on a platform 32 carried by the chassis 12 under the body 20. Platform 32 is preferably removably connected to the chassis 12, thus allowing different object projecting apparatus to be interchanged on the same chassis. The body 20 may be rotated completely over about the hinge 22 and laid on its top behind the chassis 12 while using the object projecting apparatus 24.

The object projecting apparatus can be configured to simulate a variety of sports in which one playing piece is swung to strike or throw another playing piece. The object projecting apparatus may have, for example, a bat for hitting baseballs, a foot for kicking footballs or soccer balls, a hand for throwing basketballs, a golf club for hitting golf balls, a tennis racket for hitting tennis balls, and a hockey stick for hitting hockey pucks. The figures illustrate embodiments which simulate baseball, basketball, soccer, and football.

Figure 5:
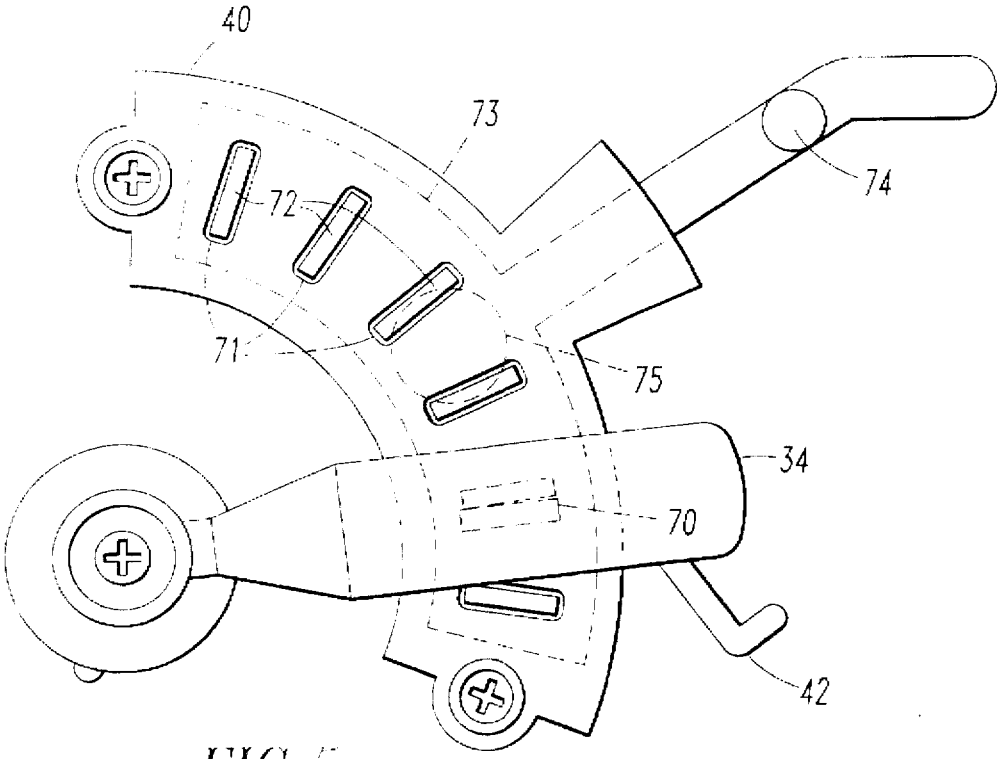
FIG. 5 is a top plan view of a present preferred embodiment of the catch and release mechanism used in the embodiment of FIGS. 2, 3 and 4.
Figure 6:
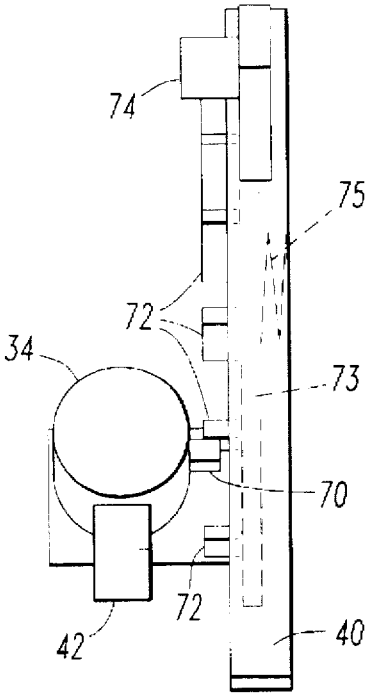
FIG. 6 is an end view of the catch and release mechanism shown in FIG. 5.

In FIGS. 2, 3 and 4, the object projecting apparatus 24 simulates a baseball bat 34 striking a baseball 52. The apparatus 24 includes a baseball bat shaped spring loaded arm 34 having one end 36 engaged by a spring 68 and anchored to the platform 32. The distal end of the arm 34 is provided with a finger tab 42, shown most clearly in FIG. 5, by which the spring loaded arm, or "bat," 34 may be conveniently drawn back against the spring 68. A cup 44 is provided as a combination object holder and aiming mechanism. A miniature baseball 52 rests on the cup 44 until the "bat" 34 is drawn back against the spring 68 and released. The farther back the spring loaded arm 34 is drawn the greater the force exerted on the arm 34 by the spring 68. The cup 44 is slidingly positioned in slot 60. As indicated by the arrow in FIG. 3, the cup 44 can be adjusted to the left or the right to aim the ball 52. The arc shaped base 40 may have markings thereon to indicate the force with which the ball will be struck. Several indentions 46, shown most clearly in FIG. 3, are formed in the platform 32 to store extra balls 52. The preferred catch and release mechanism, illustrated in FIGS. 5 and 6, is provided integral to the arc shaped base 40. Spring loaded arm 34 is provided with a catch tab 70 which may releasably engage any one of multiple spaced tab stops 72. As shown in FIG. 6, the tab stops 72 extend up through slots 71 in the base 40. Tab stops 72 may rest on or be integral to plate 73 which is biased against tab stops 72 by biasing spring 75. The distal end of catch tab 70 has an angled edge facing the tab stops 72 in the direction in which the spring loaded arm 34 is rotated to load the spring 68. The opposite face of the catch tab 70 is a flat surface. When the arm 34 is rotated back, the catch tab 70 causes a downward deflection of tab stops 72 which depress plate 73 and biasing spring 75. Once the catch tab 70 has passed over a deflected tab stop 72, the tab stop is urged back to its extended position by biasing spring 75. The flat surface of the catch tab 70 is thus retained by the extended tab stop 72. The catch tab 70 may be released by depressing lever 74 which operatively engages the plate 73 and biasing spring 75 causing the tab stops 72 to be lowered thus disengaging the catch tab 70 and allowing the spring loaded arm 34 to swing forward.

A second preferred object projecting apparatus 26 shown in FIGS. 7 through 10 simulates a hand 38 throwing a basketball 54. The apparatus 26 includes a spring loaded arm 34 having one end 36 engaged by a spring 68 and anchored to the base 40, and a functional end 38 in the shape of a hand which also serves as the object holder in this embodiment. The functional end is provided with a finger tab 42, shown most clearly in FIG. 7, by which the spring loaded arm 34 may be conveniently drawn back against the spring 68 and be held by the catch mechanism 76 shown most clearly in FIGS. 9 and 10. When released, the spring propels the arm forward thus projecting a miniature basketball 54. The spring loaded arm 34 is attached to a base 40 which is pivotably attached to the platform 32 to permit rotation of the base 40. This allows the user to aim the throw of the ball 54 by rotating the base 40 on the platform 32. Several indentions 46 are formed in the platform 32 to store extra balls. The arc shaped member 48 may have markings thereon to indicate the level of force with which the ball will be thrown. The farther back the spring loaded arm 34 is drawn the greater the force exerted on the arm 34 by the spring 68. The arm 34 is held by a catch and release mechanism shown in FIGS. 9 and 10. A catch tab 70 releasably engages any one of multiple spaced notches 78 in catch mechanism 76. The notches 78, illustrated best in FIG. 10, have an angled edge facing the catch tab 70 such that as the arm 34 is rotated against the spring 68 and the catch tab contacts a notch 78, the catch mechanism 76 is urged downward by the angled edge. As the catch tab 70 passes over the notch 78 the biasing spring 82 forces the catch mechanism 76 back out. The flat edge of the notch 78 then engages the catch tab 70 and holds the arm 34 in position. Pressing the release button 80 urges the catch mechanism 76 downward which depresses the biasing spring 82 and releases the catch tab 70 to allow the spring loaded arm 34 to swing forward.

Figure 11:
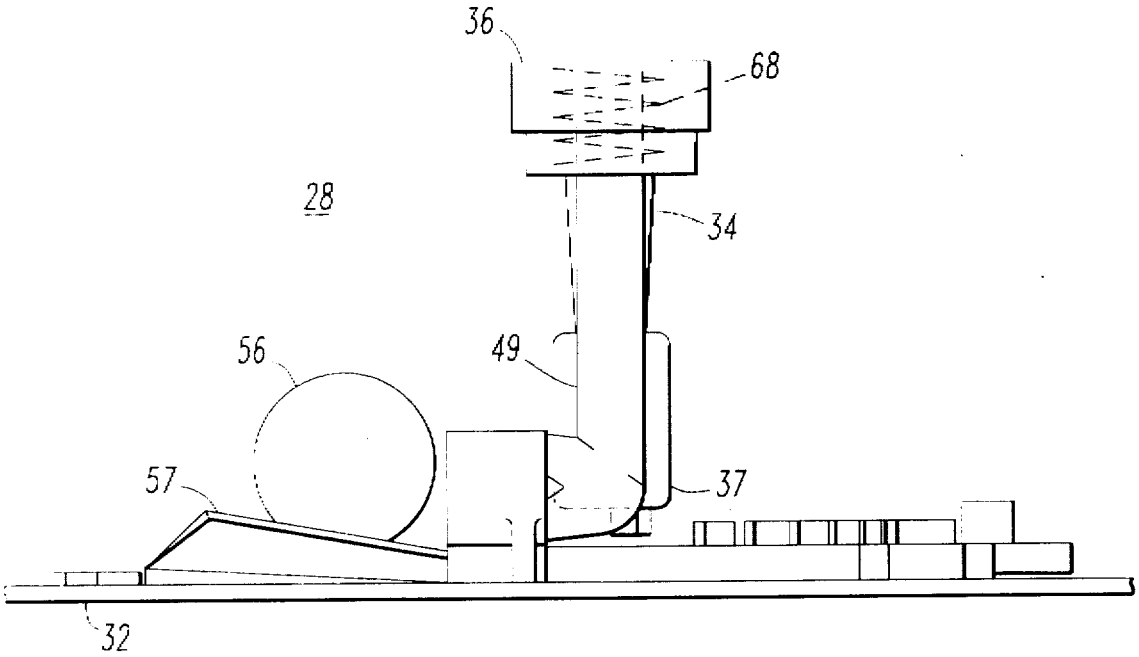
FIG. 11 is a side view of a third present preferred embodiment of our object projecting apparatus.
Figure 12:
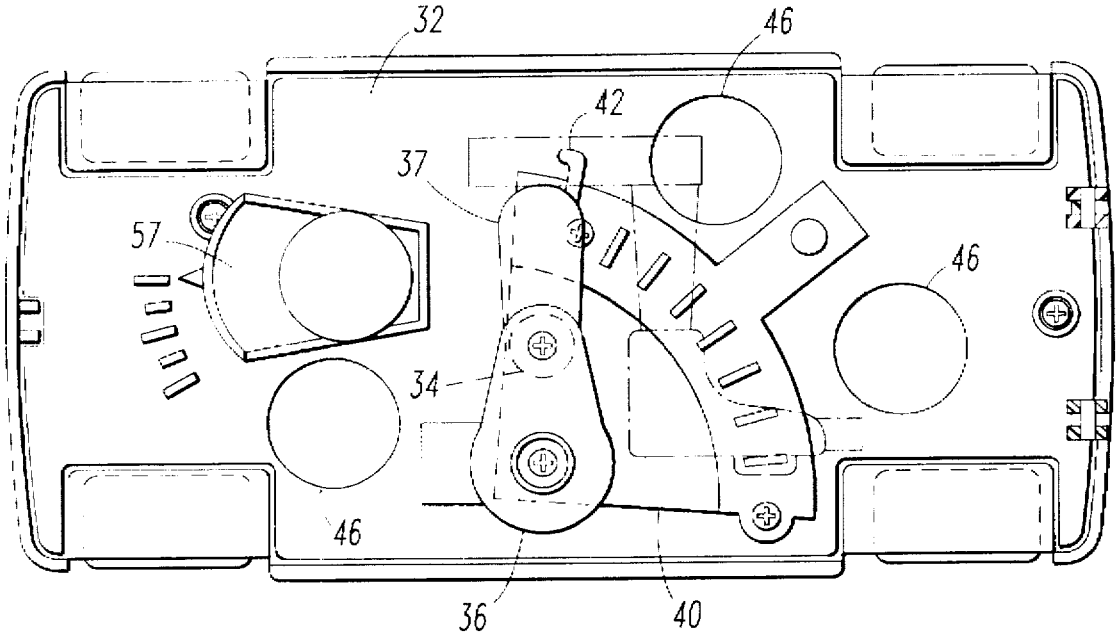
FIG. 12 is a top plan view of the object projecting apparatus shown in FIG. 11.
Figure 13:
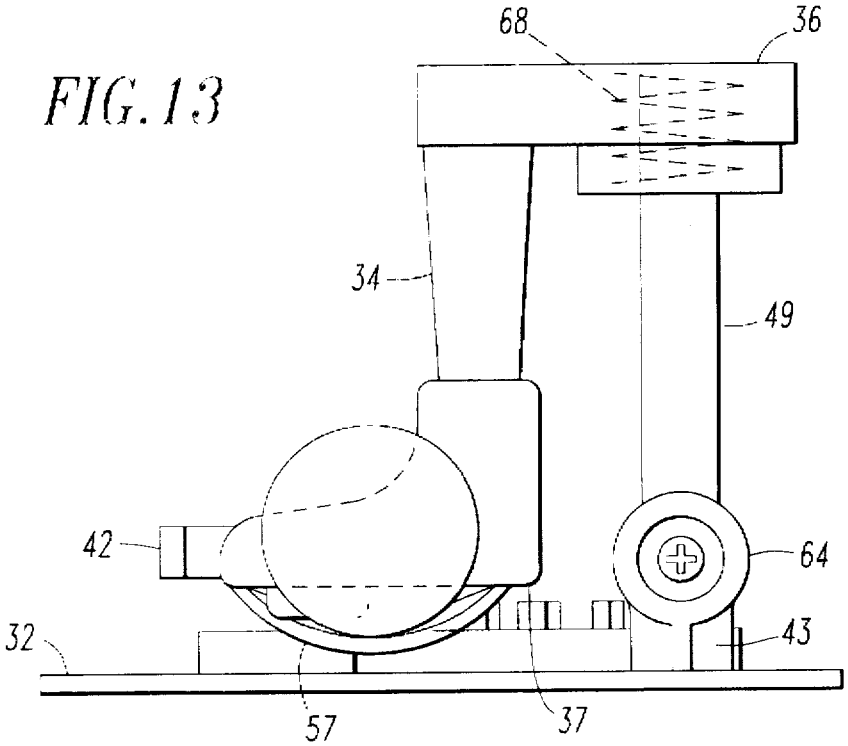
FIG. 13 is a front view of the object projecting apparatus shown in FIG. 11.

A third embodiment of our object projecting apparatus 28, shown in FIGS. 11, 12 and 13, simulates a foot 37 kicking a soccer ball 56. The apparatus 28 includes a spring loaded arm 34 having one end 36 engaged by a spring 68 and anchored to the base 40, and a functional end in the shape of shoe 37 opposite the anchored end 36. The functional end 37 is provided with a finger tab 42, shown most clearly in FIGS. 12 and 13, by which the spring loaded arm 34 may be conveniently drawn back against the spring 68. As shown best in FIGS. 11 and 13, the arm 34 may be attached at the spring loaded end 36 to a folding member 49. The folding member 49 is attached to mounting 43 by hinge 64 so that the spring loaded arm 34 and folding member 49 may fold down to the position shown in chain line in FIG. 12. When so positioned, the body 20 can completely close over the chassis 12. The arc shaped base 40 may have numbers or other markings thereon to indicate the force with which the object will be struck. The farther back the spring loaded arm 34 is drawn the greater the force exerted on the arm 34 by the spring 68. Trough shaped member 57, acts as a combination object holder and aiming mechanism. A miniature soccer ball 56 is held in the trough 57 until struck by shoe 37 on the spring loaded arm 34. The trough 57 is pinned at the end in communication with the spring loaded arm 34 and slidingly attached at the opposite end. The trough 57 can be adjusted to the right or left, in order to aim the ball 56, by rotating it about the pinned end. Several indentions 46 are formed in the platform 32 to store extra balls. This embodiment utilizes the catch and release mechanism shown in FIGS. 5 and 6. In this embodiment the catch and release mechanism is provided integral to the arc shaped base 40.

Figure 9:
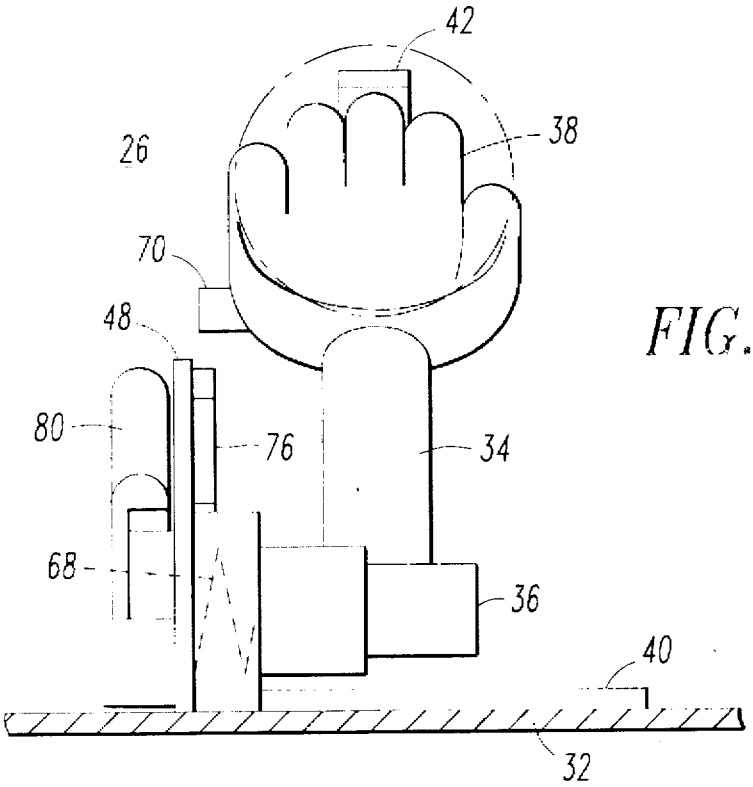
FIG. 9 is a front view of the object projecting apparatus shown in FIG. 7 with a second present prefered embodiment of our catch and release mechanism.
Figure 10:
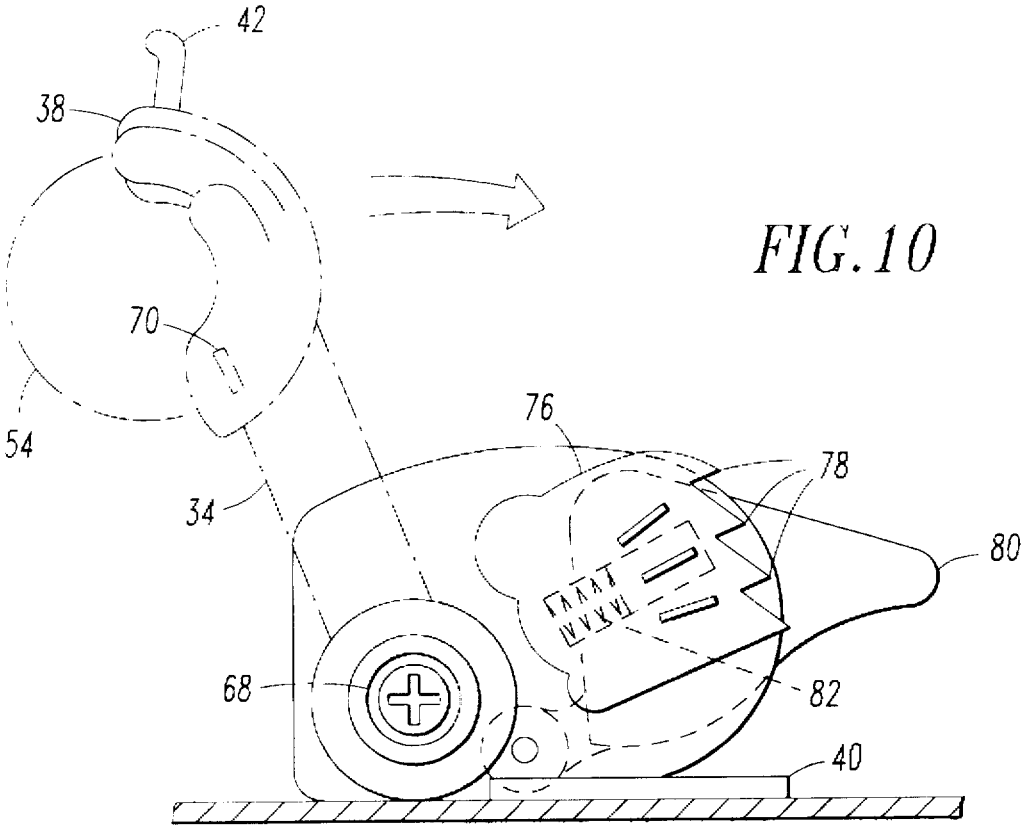
FIG. 10 is a side view of our catch and release mechanism shown in FIGS. 9.
Figure 16:
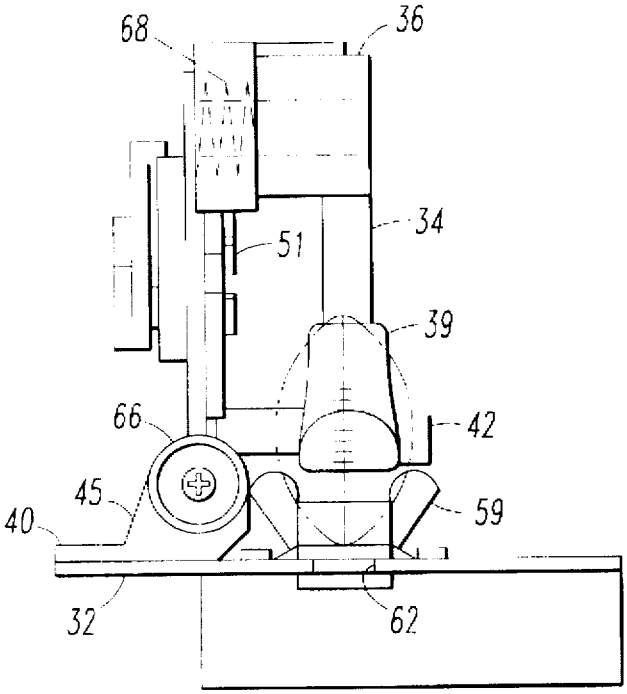
FIG. 16 is a front view of the object projecting apparatus shown in FIG. 14.

In a fourth preferred embodiment shown in FIGS. 14, 15 and 16, the object projecting apparatus 30 simulates a foot 39 kicking a football 58. A finger tab 42 extends from foot 39 by which the spring loaded arm 34 may be conveniently drawn back against the spring 68. The arc shaped member 51 is attached at hinge 66 to mounting 45 on base 40, as shown in FIG. 16, so that both the spring loaded arm and the arc shaped member 51 may be folded down to the position shown by the chain line in FIG. 15. This permits the body 20 to be completely closed onto the chassis 12. The arc shaped member 51 may have numbers or other markings thereon to indicate the force with which the object will be struck. The farther back the spring loaded arm 34 is drawn the greater the force exerted on the arm 34 by the spring 68. Football tee shaped member 59 acts as a combination object holder and aiming mechanism. A miniature football 58 is held by the tee 59 until struck by the foot 39 on the spring loaded arm 34. The tee 59 is slidingly attached in a slot 62 in the platform 32, as illustrated most clearly in FIG. 15. The tee 59 can be adjusted forwards or backwards in order to variably adjust the height and distance which the ball 58 may travel. Several indentions 46 are formed in the platform 32 to store extra balls. Additionally, the catch and release mechanism shown in FIGS. 9 and 10 is provided. In this embodiment the catch and release mechanism is provided integral to the arc shaped member 51.

Figure 17:
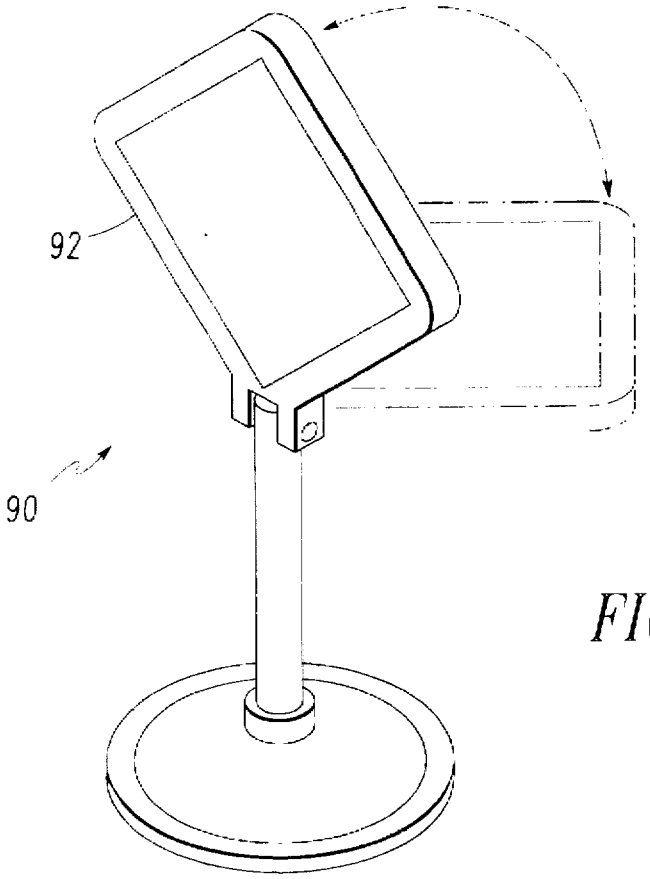
FIG. 17 is a perspective view of a goal for use with the first preferred object projecting apparatus.
Figure 18:
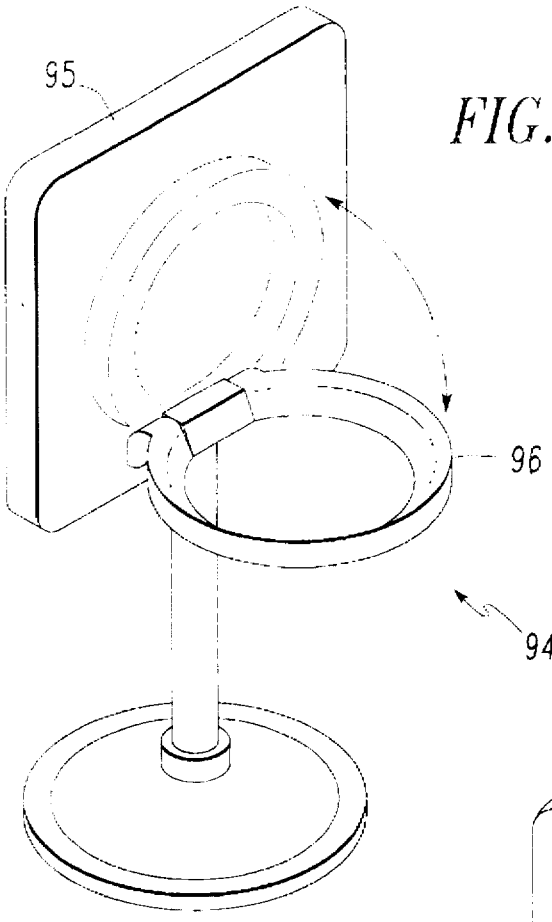
FIG. 18 is a perspective view of a goal for use with the second preferred object projecting apparatus.
Figure 20:
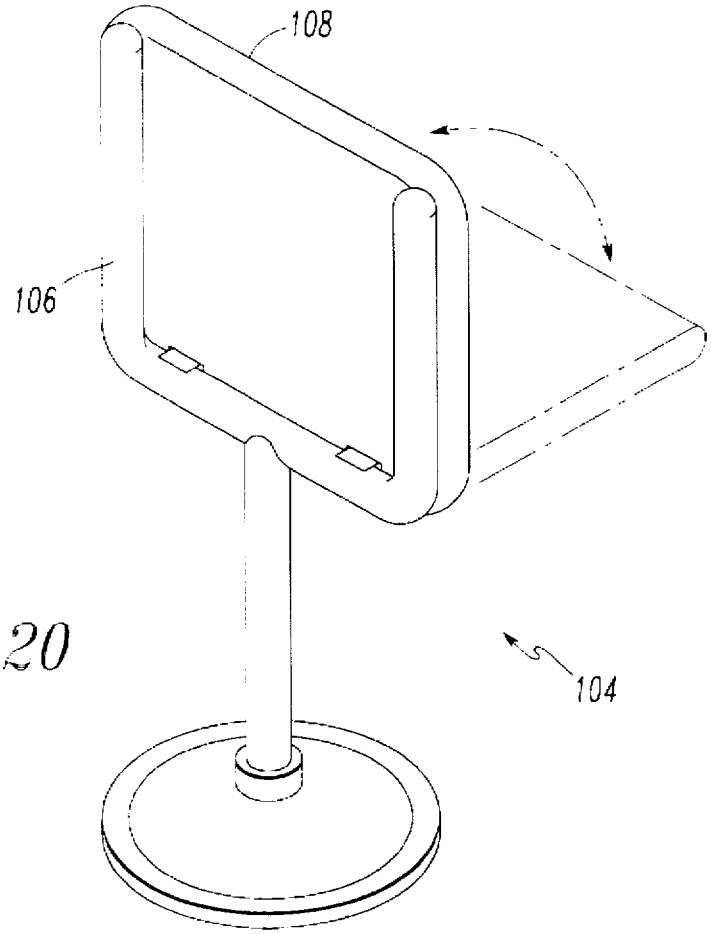
FIG. 20 is a perspective view of a goal for use with the fourth preferred object projecting apparatus.
Figure 19:
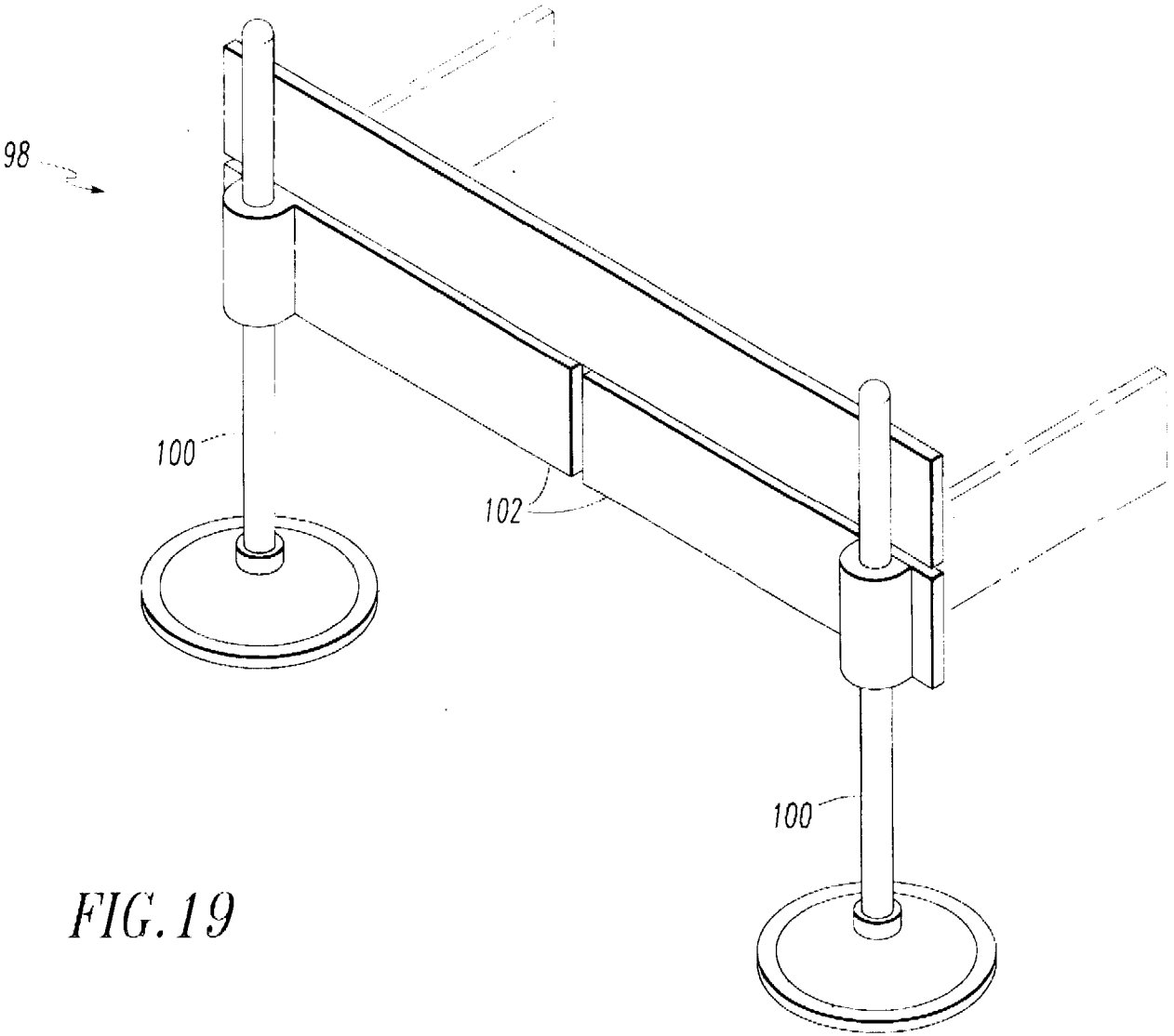
FIG. 19 is a perspective view of a goal for use with the third preferred object projecting apparatus.

We prefer to provide targets or goals that can be sold with the toy vehicle. For the first embodiment we provide a toy road sign 90, shown in FIG. 17, wherein the top portion 92 of the sign 90 will fold over when struck by the miniature baseball. For the second embodiment we provide a toy street sign 94 which has a toy basketball goal 96 that can fold down from the sign portion 95, as shown in FIG. 18. For the third embodiment we provide a toy road barrier 98 having toy soccer goal posts 100, shown in FIG. 19, wherein the lower barrier 102 can be split apart by the user to simulate a soccer net or will open when struck by the toy soccer ball. For the fourth embodiment we provide a toy road sign 104 having football field goal posts 106 attached to the sign portion 108, as shown in FIG. 20. The sign portion 108 can be folded down by the user to expose goal posts or will fold down when struck by the toy football.

While specific embodiments of the invention have been described in detail, it will be appreciated by those skilled in the art that various modifications and alternatives to those details could be developed in light of the overall teachings of the disclosure. Accordingly, the particular system and apparatus disclosed herein are intended to be illustrative only and not limiting to the scope of the invention which should be awarded the full breadth of the following claims and any and all embodiments thereof.

We claim:

1. A toy vehicle useable as either a toy vehicle or a game projectile projector comprising:

a) a chassis shaped as a toy vehicle chassis with a hinged liftable body with said chassis normally contained under said body when said body is closed upon said chassis; and b) an object projecting apparatus mounted on the chassis, said apparatus comprised of:

i) a spring biased arm which can be moved from a rest position to at least one biased position, the arm configured to simulate one of an arm, a leg and a playing piece which is moved to one of strike and throw another playing piece simulating a sports game projectile; and ii) a catch and release mechanism to which the spring biased arm is engagable when in a biased position and a command actuated trigger release which is normally hidden.

2. The toy vehicle of claim 1 also comprising a body releasably connected to the chassis and sized to enclose the object projecting apparatus.

3. The toy vehicle of claim 2 also comprising a hinge connected between the body and the chassis.

4. The toy vehicle of claim 1 wherein the toy vehicle is in the shape of a sports car.

5. The toy vehicle of claim 1 also comprising an object holder mounted on the chassis adjacent the arm so that an object placed on the object holder will be struck by the arm when the arm is released by the catch mechanism.

6. The toy vehicle of claim 5 wherein the object holder is movably attached to the chassis so that the object may be projected in a desired direction.

7. The toy vehicle of calim 1 also comprising a platform removably attached to the chassis on which the object projecting apparatus is mounted.

8. The toy vehicle of calim 1 also comprising a platform attached to the chassis in a manner so that the platform is movable relative to the chassis.

9. The toy vehicle of claim 1 also comprising a platform attached to the chassis and a base on which the object projecting apparatus is mounted, said base having a forward end pinned to the platform and an opposite end slidingly attached to the platform permitting the spring loaded arm to be oriented in different directions.

10. The toy vehicle of calim 1 also comprising a mounting extending from the chassis and a hinge connected between the mounting and the catch and release mechanism which permits the catch and release mechanism to be folded down against the platform.

11. The toy vehicle of calim 1 also comprising a finger tab attached to the arm so that the arm may be conveniently rotated relative to the catch and release mechanism.

12. The toy vehicle of claim 1 also comprising a cupped hand attached to the arm which hand is sized to hold a ball.

13. The toy vehicle of claim 1 wherein the arm is in the shape of a baseball bat.

14. The toy vehicle of claim 1 also comprising a shoe attached to the arm.

15. The toy vehicle of claim 1 also comprising a goal spaced apart from the toy vehicle.

16. The toy vehicle of claim 15 wherein the goal is configured to be converted to one of a toy road sign and a toy road barrier.

17. A toy vehicle comprising:

a) a chassis shaped as a toy vehicle chassis, and b) an object projecting apparatus mounted on the chassis comprised of:

i) a spring biased arm which can be moved from a rest position to at least one biased position; and ii) a catch and release mechanism to which the spring biased arm is engagable when in a biased position, wherein the catch and release mechanism has a plurality of spaced apart movable tabs that releasably engage the arm, the tabs being positioned so that the arm may be retained at a selected position corresponding to a position of one of the plurality of tabs when moved relative to the catch and release mechanism and then released by movement of the tab at the selected position.

18. The toy of claim 17 also comprising a catch tab extending from the arm for engagement of the movable tabs of the catch and release mechanism.

19. The toy vehicle of claim 17 wherein the movable tabs are radially arranged.

20. A toy vehicle comprising:

a) a chassis shaped as a toy vehicle chassis; and b) an object projecting apparatus mounted on the chassis comprised of:

i) a spring biased arm which can be moved from a rest position to at least one biased position;

ii) a catch and release mechanism to which the spring biased arm is engagable when in a biased position; and iii a catch tab extending from the arm and wherein the catch and release mechanism comprises a series of radially aligned spaced notches which may be selectively engaged by the catch tab.

* * * * *

UNITED STATES PATENT AND TRADEMARK OFFICE

CERTIFICATE OF CORRECTION

PATENT NO. : 5,759,083

DATED : June 2, 1998

INVENTOR(S) : DOUGLAS POLUMBAUM, SEAN R.O'MEALLIE

It is certified that error appears in the above-indentified patent and that said Letters Patent is hereby corrected as shown below:

On title page,

At [56] References Cited, change "5,297,260 4/1994" to "5,397,260 4/1995--

Column 6, claim 7, line 25, change "calim" to --claim--.

Column 6, claim 8, line 28, change "calim" to --claim--.

Column 6, claim 10, line 37, change "calim" to --claim--.

Column 6, claim 11, line 42, change "calim" to --claim--.

Signed and Sealed this

Third Day of November, 1998

*Attest:*

*Attesting Officer*

Bruce Lehman

BRUCE LEHMAN

*Commissioner of Patents and Trademarks*